US008753086B2

(12) United States Patent
Higo et al.

(10) Patent No.: US 8,753,086 B2
(45) Date of Patent: Jun. 17, 2014

(54) BLOWER FAN

(75) Inventors: Asahi Higo, Gumma (JP); Seung-Sin Yoo, Gumma (JP); Osamu Sekiguchi, Gumma (JP); Taro Tanno, Gumma (JP)

(73) Assignee: Nidec Servo Corporation, Gumma (JP)

( * ) Notice: Subject to any disclaimer, the term of this patent is extended or adjusted under 35 U.S.C. 154(b) by 674 days.

(21) Appl. No.: 13/026,338

(22) Filed: Feb. 14, 2011

(65) Prior Publication Data

US 2011/0200429 A1 Aug. 18, 2011

(30) Foreign Application Priority Data

Feb. 15, 2010 (JP) ..... 2010-030538

(51) Int. Cl.

| | |
|---|---|
| ***F04D 19/00*** | (2006.01) |
| ***F04D 25/06*** | (2006.01) |
| ***F04D 29/18*** | (2006.01) |
| ***F04D 29/32*** | (2006.01) |
| *F04D 29/66* | (2006.01) |

(52) U.S. Cl.

CPC ..... *F04D 19/002* (2013.01); *F04D 25/0613* (2013.01); *F04D 29/181* (2013.01); *F04D 29/326* (2013.01); *F04D 29/663* (2013.01)

USPC ..... 416/179; 416/193 R; 416/242; 415/211.2; 415/220

(58) Field of Classification Search

CPC . F04D 19/002; F04D 25/0613; F04D 29/181; F04D 29/326; F04D 29/663

USPC ..... 416/179, 192, 193 R, 242, 243; 415/211.2, 220

See application file for complete search history.

(56) References Cited

U.S. PATENT DOCUMENTS

| | | | | |
|---|---|---|---|---|
| 4,569,631 | A | 2/1986 | Gray, III | |
| 4,569,632 | A | 2/1986 | Gray, III | |
| 4,684,324 | A | 8/1987 | Perosino | |
| 5,755,557 | A * | 5/1998 | Alizadeh | 416/193 R |
| 6,241,474 | B1 | 6/2001 | Alizadeh et al. | |
| 6,514,052 | B2 * | 2/2003 | Bostwick | 417/366 |
| 6,554,574 | B1 | 4/2003 | Spaggiari | |
| D511,824 | S | 11/2005 | Chen et al. | |
| 7,484,925 | B2 * | 2/2009 | Carlson et al. | 415/79 |
| 7,946,824 | B2 | 5/2011 | Iwase et al. | |
| 2002/0141871 | A1 * | 10/2002 | Medamaranahally | 416/193 R |
| 2005/0180849 | A1 | 8/2005 | Chen et al. | |

(Continued)

FOREIGN PATENT DOCUMENTS

| | | | |
|---|---|---|---|
| JP | 2002-081695 | A | 3/2002 |
| WO | WO 2008072516 | A1 * | 6/2008 |

*Primary Examiner* — Igor Kershteyn

(74) *Attorney, Agent, or Firm* — Keating & Bennett, LLP

(57) ABSTRACT

An impeller includes a substantially cylindrical cup portion arranged to rotate about a center axis, a plurality of blades fixed to an outer circumferential surface of the cup portion for unitary rotation with the cup portion to draw air from one axial side and discharge the air to the other axial side, and an annular connector portion arranged to interconnect the blades. The connector portion has a substantially cylindrical shape in a position spaced apart about 70% to about 90% of the radial length of the blades from the base of each of the blades on the outer circumferential surface of the cup portion, and the ratio of a total axial height of the connector portion to a total radial gap between the outer circumferential surface of the cup portion and the inner circumferential surface of the connector portion is equal to or smaller than about 0.9.

7 Claims, 11 Drawing Sheets

(56) References Cited

U.S. PATENT DOCUMENTS

2007/0258812 A1* 11/2007 Lee et al. ..... 415/220
2008/0056899 A1 3/2008 Jiang et al.
2010/0068060 A1 3/2010 Ota et al.
2010/0086405 A1 4/2010 Higo et al.

* cited by examiner

| | Outer Diameter (D) of Cup Portion [mm] | Draft Width (W) [mm] | Axial Height (L) of Connector Portion [mm] | Ratio (L/W) |
|---|---|---|---|---|
| Impeller 1 | 55 | 11.9 | 22.6 | 1.90 |
| Impeller 2 | 46 | 16.4 | 22.6 | 1.38 |
| Impeller 3 | 46 | 16.4 | 17.4 | 1.06 |
| Impeller 4 | 42 | 18.4 | 16.5 | 0.90 |
| Impeller 5 | 42 | 18.4 | 14.5 | 0.79 |

Fig. 8

BLOWER FAN

BACKGROUND OF THE INVENTION

1. Field of the Invention

The present invention relates to an impeller arranged to generate an air stream flowing along a center axis and more specifically, to a blower fan using such an impeller.

2. Description of the Related Art

In a conventional impeller for use in a blower fan, a plurality of blades fixed to the outer circumferential surface of a cylindrical impeller cup rotates about a center axis to thereby generate an air stream flowing along the center axis.

During rotation of the impeller, radial centrifugal forces act on the blades. The influence of the radial centrifugal forces become more significant as the rotation speed of the impeller becomes greater. In case of a blade with an increased swept-forward degree, the radial outer end of the blade is positioned more forward in the rotational direction than the base thereof. For that reason, an increased moment is generated in the base due to the radial centrifugal forces acting on the respective portions of the blade. Thus, there exists a demand that the impeller be designed to sufficiently bear the radial centrifugal forces.

U.S. Patent Application Publication No. 2008/0056899 discloses a technique in which the strength of blades is increased by interconnecting the blades with a ring-shaped connector portion to reduce the influence of radial centrifugal forces.

In the disclosure of the reference cited above, however, no consideration is given to the impeller characteristics affected by the interference between the air streams generated by rotation of the blades and the ring-shaped connector portion. This interference between the air streams generated by rotation of the blades and the ring-shaped connector portion may deteriorate the impeller characteristics.

SUMMARY OF THE INVENTION

Preferred embodiments of the present invention provide an impeller that reduces the deterioration of impeller characteristics caused by the interference between an air stream generated by rotation of blades and a connector portion arranged to interconnect the blades, and a blower fan including the impeller.

In accordance with a first preferred embodiment of the present invention, an impeller includes a substantially annular connector portion arranged to interconnect a plurality of blades, wherein the connector portion is located in a position spaced apart about 70% to about 90% of the radial length of the blades from a base of each of the blades on an outer circumferential surface of the cup portion, and a ratio of a axial height of the connector portion to a radial gap between the outer circumferential surface of the cup portion and the connector portion is substantially equal to or smaller than about 0.9.

The blades may preferably include swept-forward blades. Further, the axial intake side end of the connector portion may preferably be substantially flush with the axial intake side ends of the blades in the areas of the blades connected by the connector portion, and the axial height of the connector portion may be set smaller than the axial height of the blades. The axial exhaust side ends of the blades may preferably be inclined radially outward towards the axial intake side thereof. The axial height of the connector portion may preferably be substantially equal to the axial height of the blades in the areas of the blades connected by the connector portion.

With such a configuration, the connector portion arranged to interconnect the blades in the impeller is provided in a position spaced apart about 70% to about 90% of the radial length of the blades from the base of each of the blades. This makes it possible to suppress a noise increase caused by the interference between the air streams and the connector portion. In addition, the ratio of the axial height of the connector portion to the draft width of the air streams is preferably set to be substantially equal to or smaller than about 0.9. This makes it possible to suppress the static pressure reduction caused by the increased turbulent flow in the low air flow rate zone. Consequently, it is possible to realize an impeller with increased strength of the blades against centrifugal forces while also suppressing the deterioration of the impeller characteristics. This makes it possible to provide an impeller with increased degree of freedom.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 8 is a table showing the cup portion outer diameter, the draft width and the connector portion height in impellers 1 through 5 manufactured with variations in the ratios of the connector portion height to the draft width.

DETAILED DESCRIPTION OF THE PREFERRED EMBODIMENTS

Preferred embodiments of the present invention will now be described in detail with reference to the accompanying drawings. In the description of preferred embodiments of the present, the direction parallel or substantially parallel to a center axis will be referred to as an "axial direction" and the direction perpendicular or substantially perpendicular to and intersecting with the center axis will be referred to as a "radial direction". The present invention shall not be limited to the following preferred embodiments but may be appropriately changed or modified without departing from the scope of the present invention.

Figure 1:
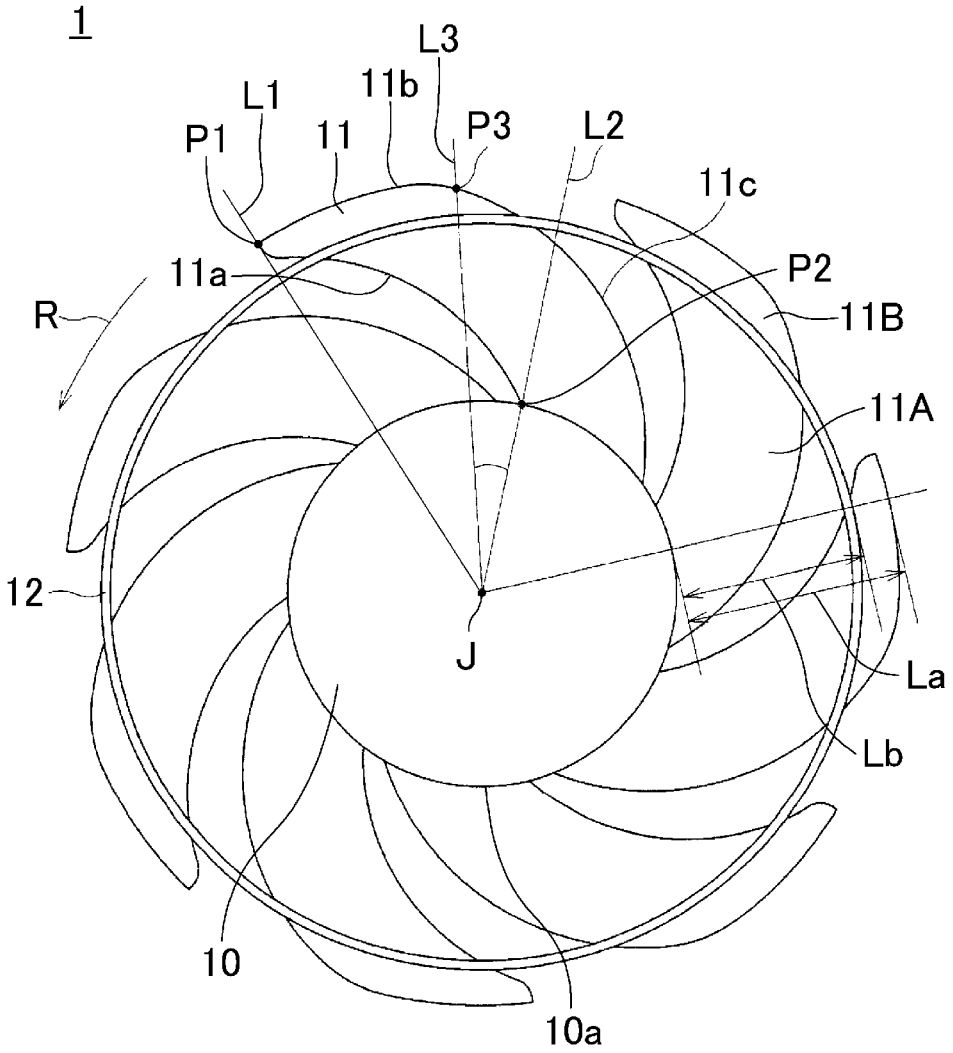
FIG. 1 is a schematic plan view of an impeller in accordance with a preferred embodiment of the present invention, which is seen from an axial intake side.
Figure 2:
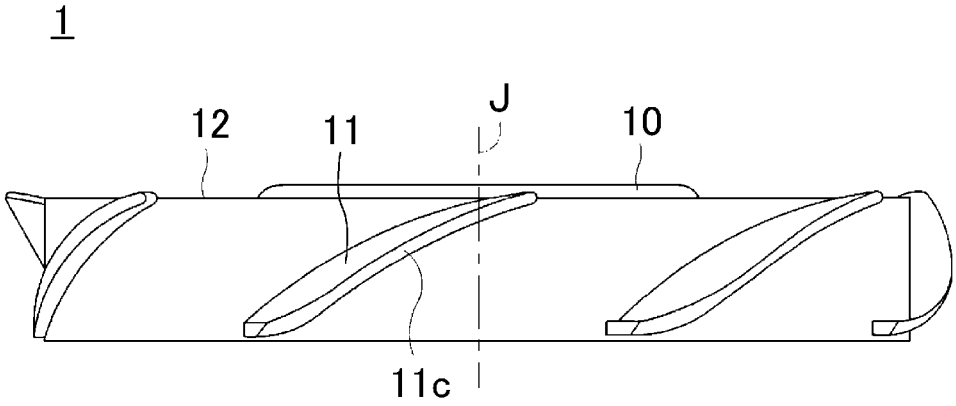
FIG. 2 is a schematic side view of the impeller shown in FIG. 1.
Figure 3:
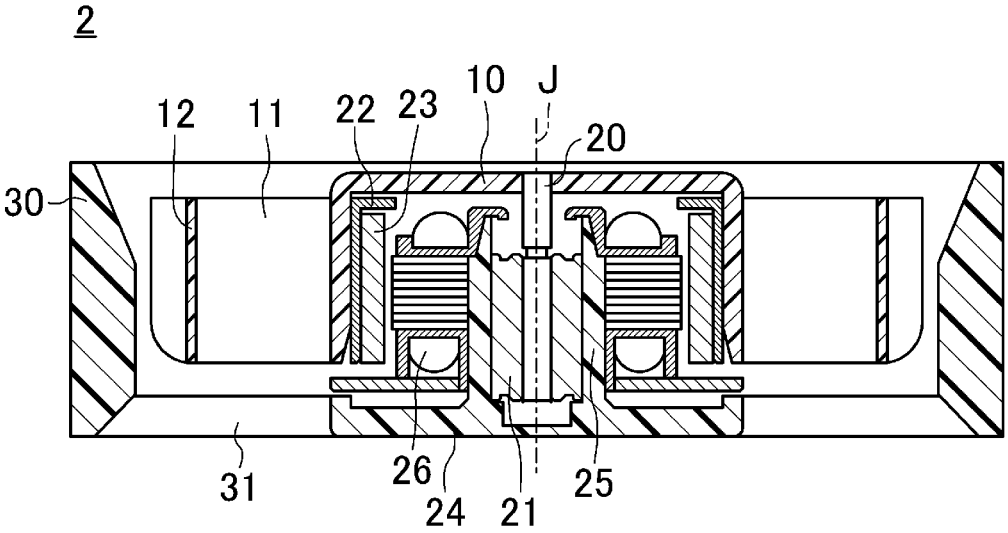
FIG. 3 is a schematic section view of a blower fan including the impeller shown in FIG. 1.

FIG. 1 is a schematic plan view of an impeller 1 in accordance with a preferred embodiment of the present invention, which is seen from an axial intake side. FIG. 2 is a schematic side view of the impeller 1 shown in FIG. 1. FIG. 3 is a schematic section view of a blower fan 2 provided with the impeller 1 shown in FIG. 1.

Referring to FIGS. 1 and 2, the impeller 1 of the present preferred embodiment preferably includes a substantially cylindrical cup portion 10 arranged to rotate about a center axis J, a plurality of blades 11 fixed to the outer circumferential surface 10*a* of the cup portion 10 such that the plurality of blades 11 is arranged to rotate with the cup portion 10 to draw the air from one axial side and discharge the air to the other axial side, and a substantially annular connector portion 12 arranged to interconnect the blades 11. It is to be noted that the connector portion 12 is preferably provided in a substantially cylindrical shape extending in a circumferential direction along an arbitrary circle concentric with the center axis J.

As shown in FIG. 3, the blower fan 2 of the present preferred embodiment preferably includes a motor arranged to drive the impeller 1, a base portion 24 arranged to support the motor, a housing 30 arranged to surround the outer circumference of the impeller 1 and a plurality of stator vanes 31 arranged to interconnect the housing 30 and the base portion 24.

The motor preferably includes a rotor holder 22 attached to the inner circumferential surface of the cup portion 10 of the impeller 1, a rotor magnet 23 attached to the inner circumferential surface of the rotor holder 22, a stator 26 including a stator core and coils wound around the stator core, and a sleeve bearing 21 fixed to the inner surface of a bearing retainer 25. A shaft 20 is preferably fixed to the central area of the cup portion 10. The shaft 20 is preferably inserted into and rotatably supported by the sleeve bearing 21.

In the blower fan 2, when a drive current is supplied to the coils of the stator 26, rotational torque is generated between the stator 26 and the rotor magnet 23. And, as a consequence of this rotational torque, the blades 11 arranged at the outer circumferential surface 10*a* of the cup portion 10 rotate about the center axis J.

The interference between the air streams generated by rotation of the blades 11 and the connector portion 12 and the influence the interference has on the characteristics of the impeller is important for the preferred embodiments of the present invention. Accordingly, the position of the connector portion 12 in the radial direction of the blades 11 are preferably accurately provided in a specific location.

Figure 4:
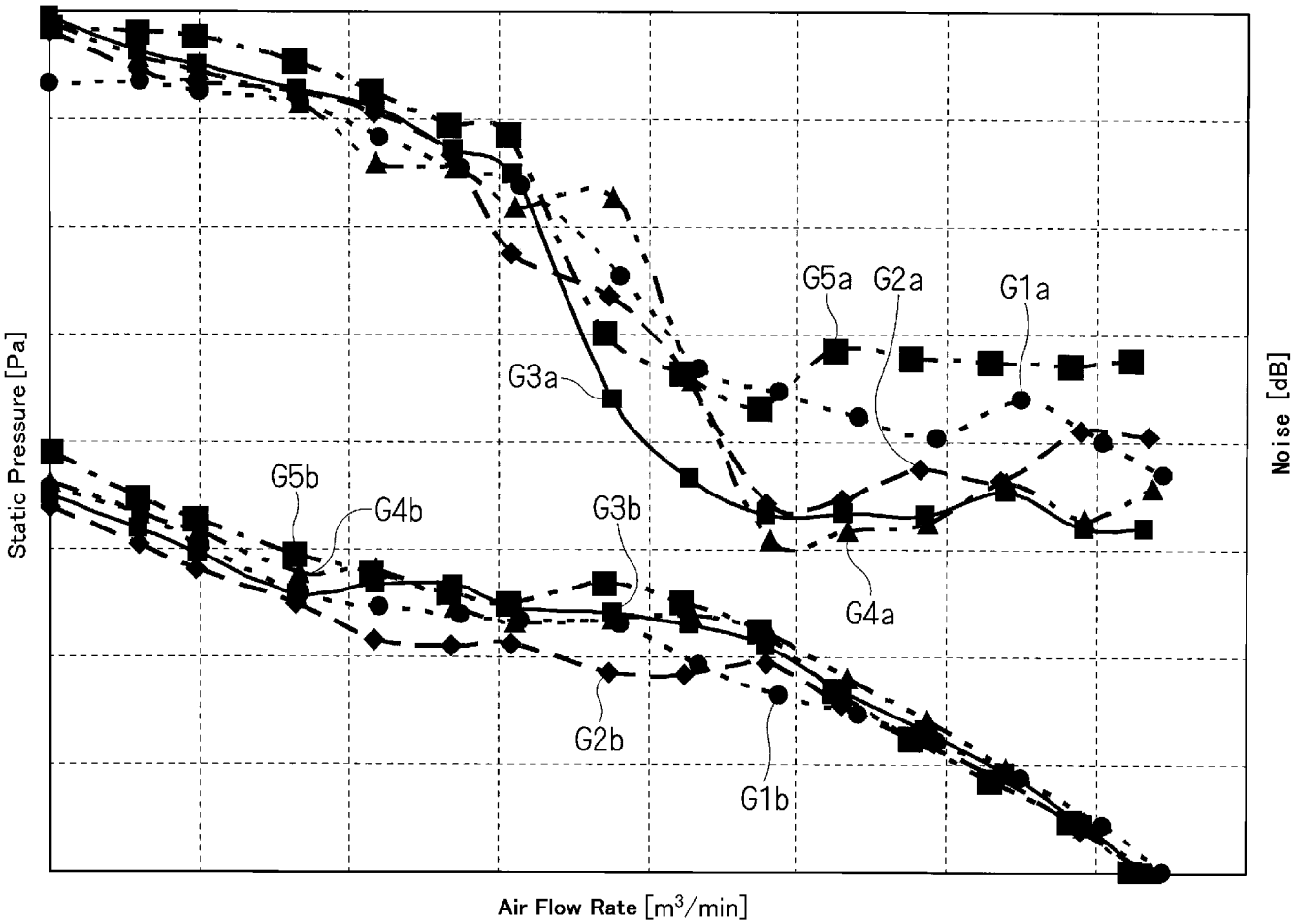
FIG. 4 is a graph showing the static pressure characteristics and the noise characteristics of a plurality of samples of the impeller with the connector portion provided in different positions.

FIG. 4 is a graph representing the static pressure characteristics and the noise characteristic of a plurality of examples of preferred embodiments of the present invention, A through E, of the impeller 1 with the connector portion 12 provided in different positions along the radial direction of the blades 11. As shown in FIG. 1, the connector portions 12 of the examples A through E are respectively provided in the positions where the radial distance Lb from the base of the blade 11 on the outer circumferential surface 10*a* of the cup portion 10 to the connector portions 12 is equal to approximately 50%, 70%, 80%, 90% and 100% of the radial length La of the blades 11. In FIG. 4, curves G1*b* through G5*b* show the relationship between the air flow rate and the static pressure in examples A through E, and curves G1*a* through G5*a* indicate the relationship between the air flow rate and the noise in examples A through E.

As can be seen in FIG. 4, the noises generated in examples A and E having the connector portions 12 provided corresponding to the 50% and 100% positions (see curves G1*a* and G5*a*) are greater than the noises generated in samples B, C and D having the connector portions 12 provided corresponding to the 70%, 80% and 90% positions (see curves G2*a*, G3*a* and G4*a*). Presumably, the reason for the noise being increased in examples A, for example, is that the radial middle portion of the blade 11 makes greater contribution to the generation of air streams and that the interference between the air streams and the connector portion 12 becomes greater in the radial middle portion of the blade 11. The reason for the noise being increased in examples E is presumed to be, for example, that reverse air streams are generated in the gap between the connector portion 12 and the side wall of the housing if the connector portion 12 is provided at the radial outer ends 11*b* of the blades 11.

Accordingly, the noise increase attributable to the provision of the connector portion 12 can be substantially suppressed by providing the connector portion 12 in a position radially spaced apart about 70% to about 90% of the radial length La of the blades 11 from the base of each of the blades 11 on the outer circumferential surface 10*a* of the cup portion 10, for example.

The connector portion 12 is preferably arranged radially inwards of the radial outer ends 11*b* of the blades 11. Therefore, the inner surface of the connector portion 12 preferably functions as the inner surface of a housing in the areas 11A of the blades 11 which is arranged radially inwards of the connector portion 12. In other words, no gap exists between the inner surface of an imaginary housing (namely, the inner surface of the connector portion 12) and the areas 11A of the blades 11 arranged radially inwards of the connector portion 12. By virtue of such a configuration, the reverse air streams are only weakly generated in the areas 11A of the blades 11 arranged radially inwards of the connector portion 12. Most of the reverse air streams pass through the areas 11B of the blades 11 arranged radially outwards of the connector portion 12. As a result, the areas 11B of the blades 11 arranged radially outwards of the connector portion 12 are arranged to prevent of the reverse air streams. This makes it possible to improve the static pressure characteristics in a low air flow rate zone while simultaneously maintaining the air flow rate characteristics of the impeller 1 in the areas 11A of the blades 11 arranged radially inwards of the connector portion 12.

The strength of the blades 11 with respect to resisting centrifugal forces is increased by interconnecting the blades 11 with the connector portion 12. The strength increasing effect is particularly evident when the blades 11 are swept-forward blades. The term "swept-forward blades" used herein means that, as shown, for example, in FIG. 1, the intersection point P1 between the frontal edge 11*a* of each of the blades 11 positioned most forwardly in the rotational direction R and the blade tip end 11*b* positioned at the radial outer end of each of the blades 11 lies more forward in the rotational direction R than the intersection point P2 between the frontal edge 11*a* and the outer circumferential surface 10*a* of the cup portion 10. The strength increasing effect is also achieved in cases where the swept-forward degree is extremely high, namely in cases where the intersection point P3 between the rear edge 11*c* of each of the blades 11 positioned rearwards in the rotational direction R and the blade tip end 11*b* positioned at the radial outer end of each of the blades 11 lies more forwardly in the rotational direction R than the intersection point P2 between the frontal edge 11*a* and the outer circumferential surface 10*a* of the cup portion 10 as shown in FIG. 1.

Figure 5:
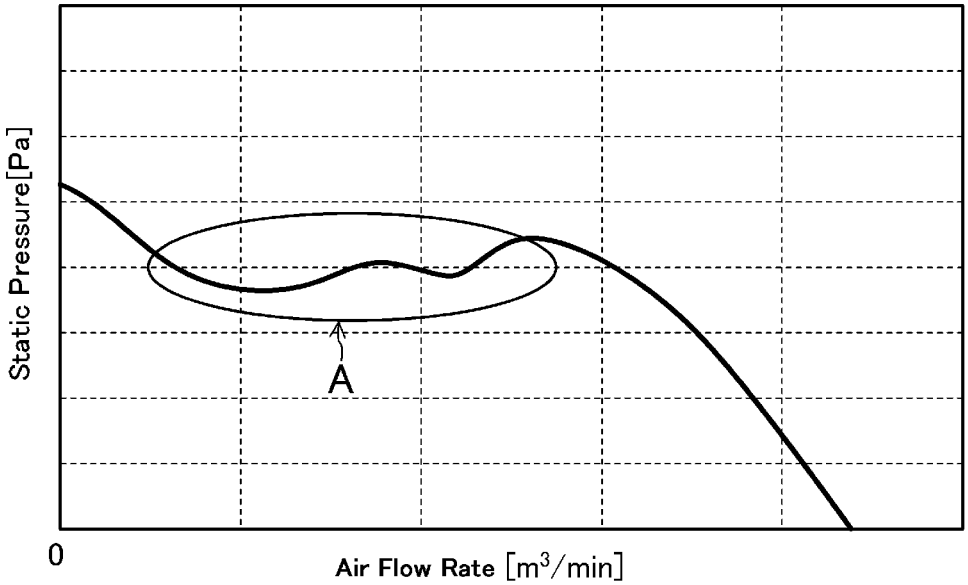
FIG. 5 is a graph showing the static pressure characteristics of an impeller whose static pressure is not sufficiently increased in a low air flow rate zone.

It should also be noted that a static pressure characteristics of the impeller 1 provided with the connector portion 12 also has a relationship to the arrangement of elements. For example, as shown in FIG. 5, the static pressure in a low air flow rate zone A may fail to become sufficiently high depending on an axial height of the connector portion 12.

Figure 6:
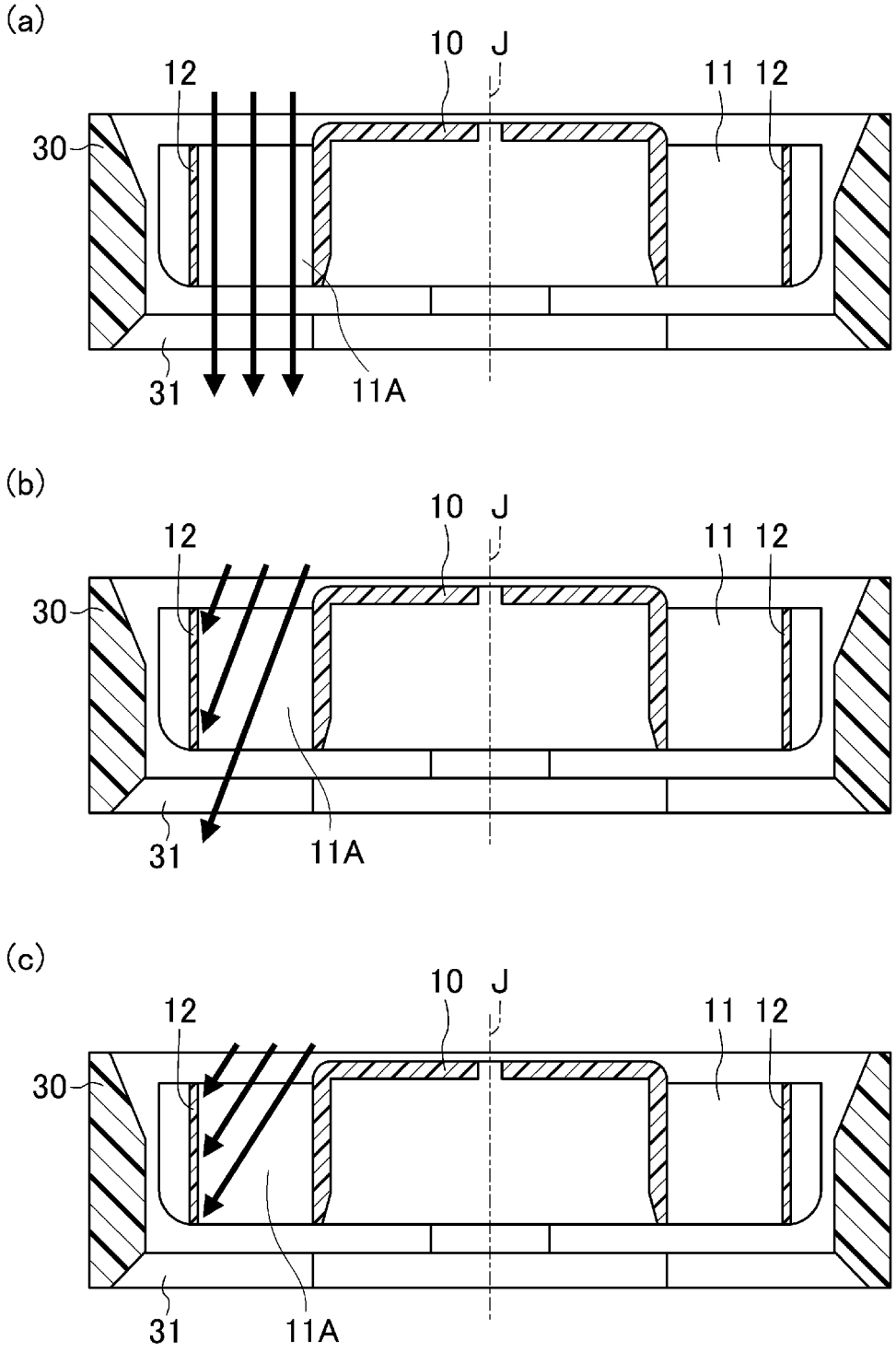
FIGS. 6A through 6C are schematic section views of a blower fan showing the air streams at different air flow rate zones with different loads applied thereto.

The failure of the static pressure to become sufficiently high in the low air flow rate zone A is likely due to the following reasons. As shown in FIG. 6A, the air streams flow straight in a high air flow rate zone with reduced load. However, the influence of centrifugal forces becomes greater when the impeller 1 comes into a low air flow rate zone due to the increased load. In this case, the air streams tend to flow radially outwards as shown in FIGS. 6B and 6C. If the air streams flowing in an oblique direction make contact with the connector portion 12, a turbulent flow is generated in the areas 11A of the blades 11 arranged radially inwards of the connector portion 12. As a result, the air streams are stalled in the areas 11A of the blades 11 for attainment of the air flow rate characteristic of the impeller 1. Presumably, this stalling impedes the increase in the static pressure.

Thus, for the purpose of suppressing the reduction of the static pressure in the low air flow rate zone A, preferred embodiments of the present invention are arranged to provide a flow path where the air streams flowing in an oblique direction do not make contact with the connector portion 12. The following examples help to illustrate the reasons for this suppression of the reduction of the static pressure.

Figure 7:
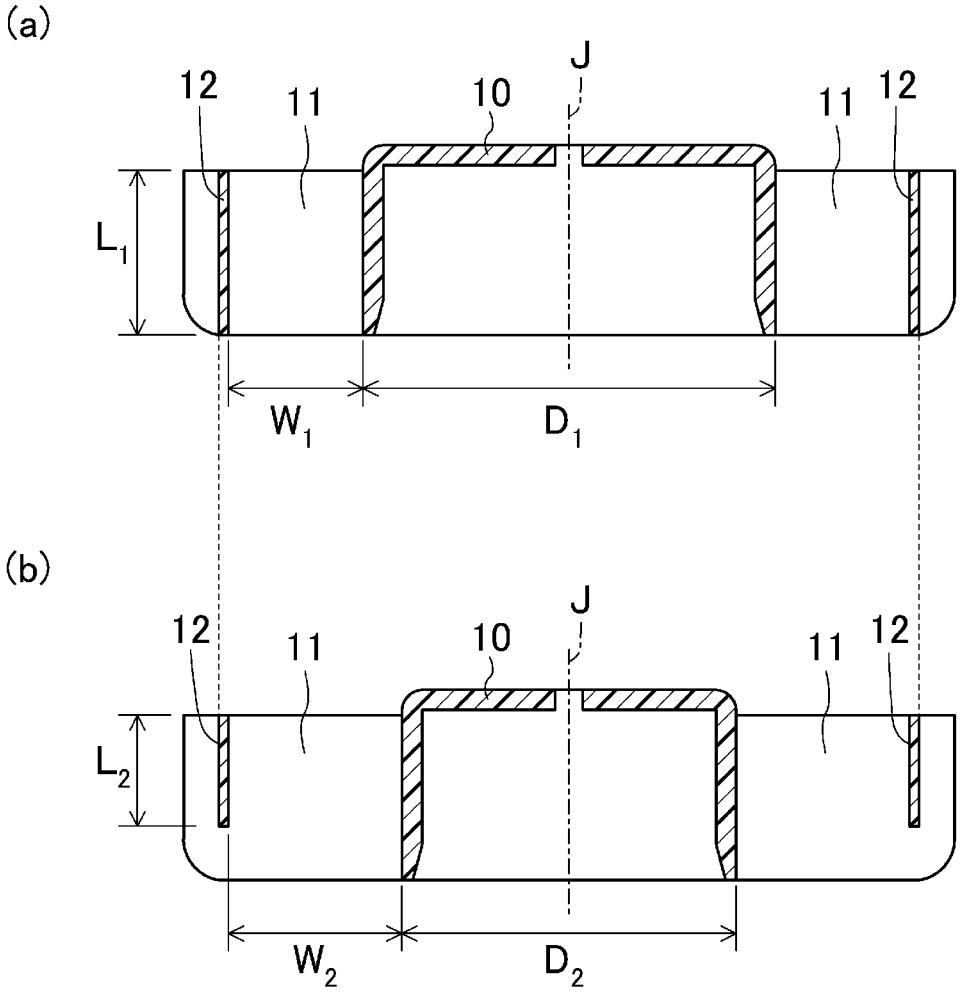
FIGS. 7A and 7B are section views of a blower fan showing the relationship between the height of a connector portion and the draft width.

In cases where the radial dimension and axial height of the blades 11 are kept constant as illustrated in FIGS. 7A and 7B, for the sake of providing a flow path where the air streams do not make contact with the connector portion 12, it is necessary to reduce the axial height L of the connector portion 12 or to increase the radial gap (hereinafter referred to as "draft width") W between the outer circumferential surface 10*a* of the cup portion 10 and the inner circumferential surface of the connector portion 12 by reducing the outer diameter D of the cup portion 10.

To this end, impellers 1 through 5 differing in the outer diameter D of the cup portion 10, the draft width W and the axial height L of the connector portion 12 were prepared as shown in FIG. 8 and subjected to measurement of static pressure characteristics.

Figure 9:
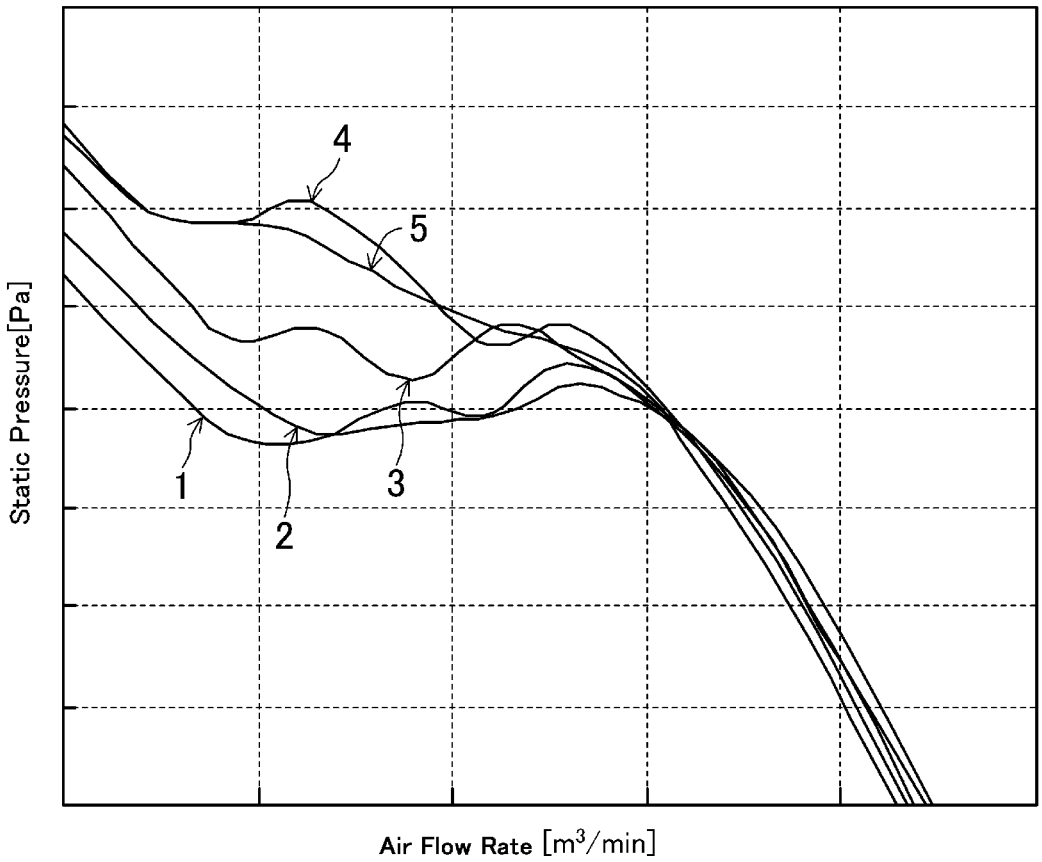
FIG. 9 is a graph representing the static pressure characteristics of impellers 1 through 5 shown in FIG. 8.

FIG. 9 is a graph representing the measurement results, in which graph curves 1 through 5 respectively indicate the static pressure characteristics of impellers 1 through 5.

Figure 10:
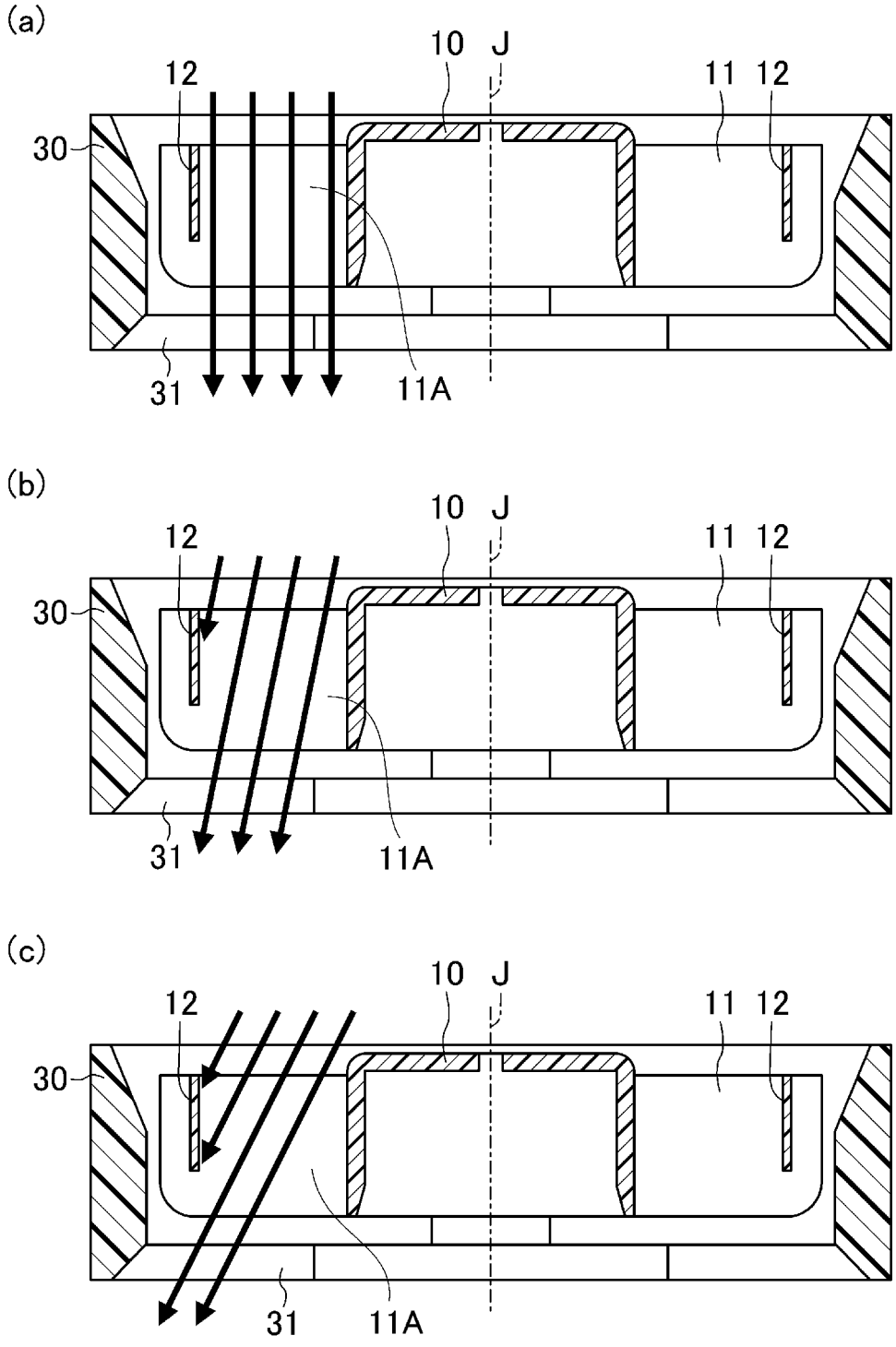
FIGS. 10A through 10C are schematic section views of a blower fan showing the air streams in the blower fan provided with the impeller according to a preferred embodiment of the present invention.

As can be seen in FIG. 9, the static pressure in the low air flow rate zone is decreased in impellers 1 through 3 but sufficiently increased in impellers 4 and 5. This is because, even if the high air flow rate zone with reduced load (see FIG. 10A) is shifted to the low air flow rate zone with increased load (see FIGS. 10B and 10C) as shown in FIGS. 10A through 10C, the generation of a turbulent flow in the areas 11A of the blades 11 arranged radially inward from the connector portion 12 is reduced as long as there is sufficiently provided a flow path where the air streams flowing in the oblique direction do not make contact with the connector portion 12.

Figure 11:
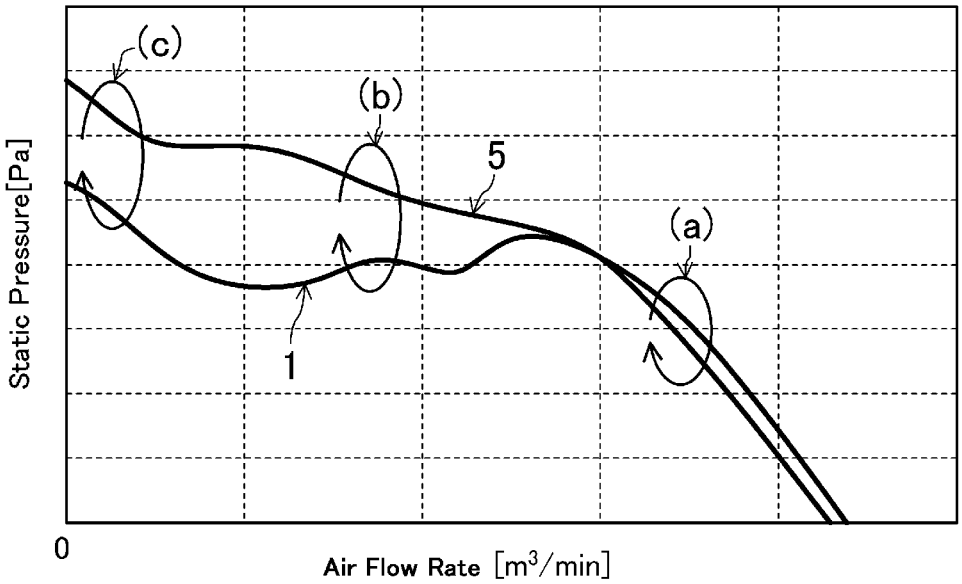
FIG. 11 is a graph comparatively representing the static pressure characteristics of impellers 1 and 5 shown in FIG. 8.

In other words, as shown in FIG. 11, no great difference in the static pressure between impellers 1 and 5 is generated in the high air flow rate zone (a) with reduced load. However, due to the difference in the flow path as shown in FIGS. 6B, 6C, 10B, and 10C, the static pressure of impeller 1 becomes far smaller than the static pressure of the impeller 5 in the low air flow rate zones (b) and (c) with increased load.

Therefore, a flow path where the air streams flowing in the oblique direction do not make contact with the connector portion 12 can be provided if the ratio L/W of the axial height L of the connector portion 12 to the radial gap W between the outer circumferential surface 10*a* of the cup portion 10 and the inner circumferential surface of the connector portion 12 is set substantially equal to or smaller than about 0.9. Consequently, it is possible to suppress the reduction of the static pressure in the low air flow rate zone A.

Figure 12:
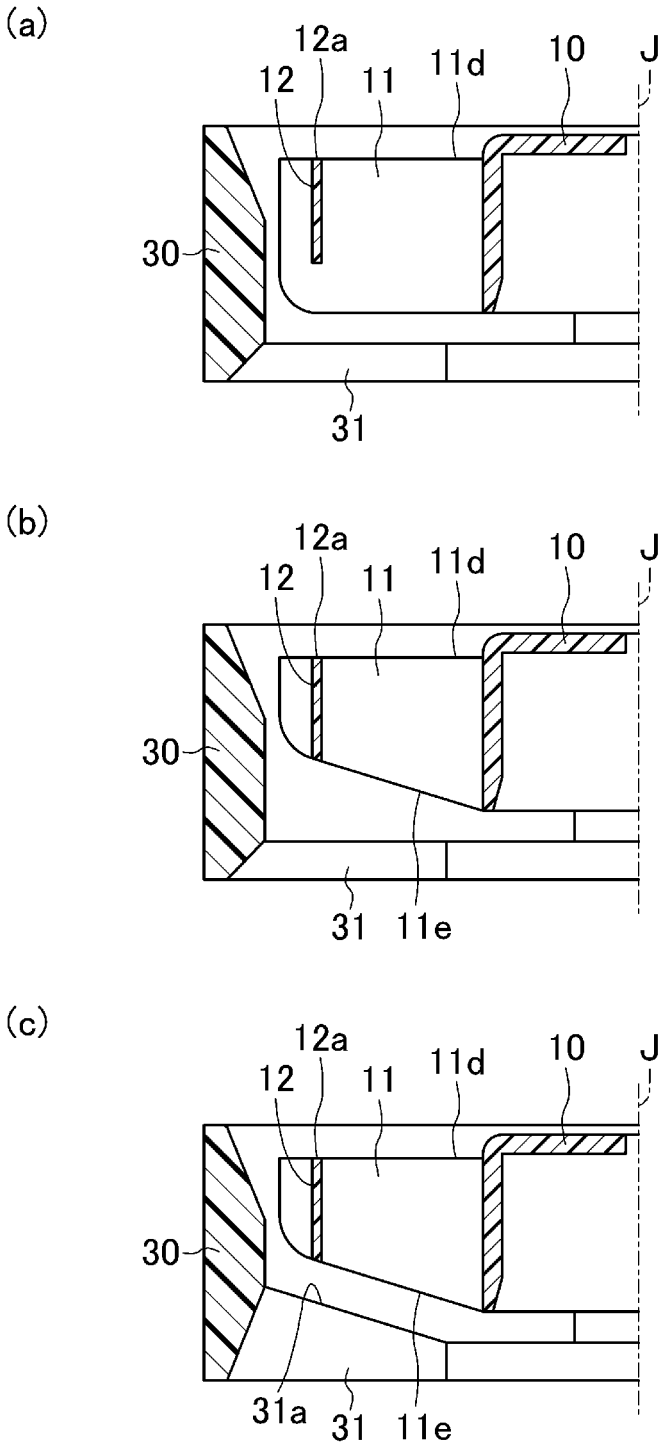
FIGS. 12A through 12C are schematic half section views showing different modified examples of the blower fan according to a preferred embodiment of the present invention.

When the flow path where the air streams flowing in the oblique direction do not make contact with the connector portion is provided by making the axial height of the connector portion 12 smaller than the axial height of the blades 11, it is preferred that, as shown in FIG. 12A, the axial intake side end (upper end) 12*a* of the connector portion 12 is substantially flush with the axial intake side ends (upper ends) 11*d* of the blades 11 in the areas of the blades 11 connected by the connector portion 12. This makes it possible to broaden the flow path where the air streams flowing in the oblique direction do not make contact with the connector portion 12.

In case where the cup portion 10, the blades 11 and the connector portion 12 are provided by a single piece through resin molding, for example, the configuration in which the axial height of the connector portion 12 is set smaller than the axial height of the blades 11 may possibly make the structure of molds needed to make a single piece are complicated. This is undesirable in terms of the manufacturing cost.

As a solution to this problem, it is preferred that, as shown in FIG. 12B, the axial exhaust side ends (lower ends) 11*e* of the blades 11 are inclined radially outward towards the axial intake side. This helps reduce the areas of the blades 11 extending toward the exhaust side from the lower end of the connector portion 12, to thereby make it possible to solve the above-noted mold complexity problem. In this case, the axial height of the connector portion 12 may be substantially equal to the axial height of the blades 11 in the areas of the blades 11 connected by the connector portion 12.

If the axial height of the connector portion 12 is set substantially equal to the axial height of the blades 11 in this manner, it becomes much easier to produce the cup portion 10, the blades 11 and the connector portion 12 into a single piece by, for example, injection molding or other methods.

When the axial exhaust side ends (lower ends) 11*e* of the blades 11 are inclined radially outward towards the axial intake side, the gap between the lower ends 11*e* of the blades 11 and the stator vanes 31 grows wider as shown in FIG. 12B. For that reason, the function of the stator vanes 31 by which the air streams generated by rotation of the impeller are concentrated toward the center axis J may possibly be impaired at the radial outer side. Moreover, if the gap between the lower ends 11*e* of the blades 11 and the stator vanes 31 grows wider, a turbulent flow is likely to be generated in the air streams. This may possibly result in a reduction in the static pressure.

As a solution to this problem, it is preferred that, as shown in FIG. 12C, the axial intake side ends 31*a* of the stator vanes 31 are inclined radially outward towards the axial intake side and the gap between the axial exhaust side ends 11*e* of the blades 11 and the axial intake side ends 31*a* of the stator vanes 31 is kept substantially constant in the radial direction. This helps prevent an impairment of the air concentrating function of the stator vanes 31 while simultaneously preventing generation of a turbulent flow in the air streams.

While the ratio L/W of the axial height L of the connector portion 12 to the radial gap W between the outer circumferential surface 10*a* of the cup portion 10 and the inner circumferential surface of the connector portion 12 is preferably set equal to or smaller than about 0.9 in various preferred embodiments of the present invention, the lower limit value of the ratio L/W is not particularly limited. For example, the lower limit value of the axial height L of the connector portion may be appropriately set depending on the strength of the blades 11 against centrifugal forces. In addition, the upper limit value of the radial gap W between the outer circumferential surface 10*a* of the cup portion 10 and the inner circumferential surface of the connector portion 12 may be suitably set depending on the outer diameter of the blower fan.

In the preferred embodiments of the present invention, the shape of the cup portion 10, the blades 11, the connector portion 12 and the stator vanes 31 and the relative positional relationship therebetween are not limited to the ones shown in FIGS. 12A through 12C. For example, the axial height of the blades 11 may be set equal to the axial height of the connector portion 12 and may be kept constant in the radial direction. The substantially cylindrical cup portion 10 may be provided in such a shape that the axial exhaust side end is inclined radially outwards. A lightweight low-priced impeller can be realized by providing the cup portion 10, the blades 11 and the connector portion 12 as a single piece through, for example, injection molding. No particular restriction is imposed on the number, swept-forward angle and entrance angle of the blades 11 and the stator vanes 31.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A blower fan, comprising:

an impeller;

a motor arranged to drive the impeller;

a base portion arranged to support the motor; and a housing arranged to surround an outer circumference of the impeller; wherein the impeller includes:

a substantially cylindrical cup portion arranged to rotate about a center axis;

a plurality of blades fixed to an outer circumferential surface of the cup portion and arranged to rotate with the cup portion to draw air from a first axial side and to discharge the air to a second axial side; and a substantially annular connector portion arranged to interconnect the plurality of blades;

the connector portion is provided with a substantially cylindrical shape in a position spaced apart about 70% to about 90% of a radial length of the blades from a base of each of the blades on the outer circumferential surface of the cup portion, and a ratio of a total axial height of the connector portion to a total radial gap between the outer circumferential surface of the cup portion and an inner circumferential surface of the connector portion is substantially equal to or smaller than about 0.9; and an axial intake side end of the connector portion is substantially flush with axial intake side ends of the blades in areas of the blades connected by the connector portion, and the total axial height of the connector portion is smaller than a total axial height of the blades.

2. The blower fan of claim 1, wherein the blades are swept-forward blades.

3. The blower fan of claim 1, wherein axial exhaust side ends of the blades are inclined radially outward towards an axial intake side of the impeller.

4. The blower fan of claim 3, wherein the total axial height of the connector portion is substantially equal to an axial height of the blades in portions of the blades connected by the connector portion.

5. The blower fan of claim 1, wherein an intersection point between a rear edge of each of the blades positioned rearwards in a rotational direction of the blades and a blade tip end positioned at a radial outer end of each of the blades lies more forward in the rotational direction than an intersection point between a front edge of each of the blades positioned forwards in the rotational direction and the outer circumferential surface of the cup portion.

6. The blower fan of claim 1, further comprising a plurality of stator vanes arranged to interconnect the housing and the base portion, each of the stator vanes including an axial intake side end inclined toward an axial intake side of the connector portion.

7. The blower fan of claim 6, wherein a gap between the axial exhaust side end of each of the blades and the axial intake side end of each of the stator vanes is substantially constant in a radial direction.

* * * * *